US010209641B2

(12) United States Patent
Okura

(10) Patent No.: US 10,209,641 B2
(45) Date of Patent: Feb. 19, 2019

(54) CHARGING DEVICE, AND IMAGE CARRYING MEMBER UNIT AND IMAGE FORMING APPARATUS THEREWITH

(71) Applicant: KYOCERA Document Solutions Inc., Osaka (JP)

(72) Inventor: Yoshimasa Okura, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 143 days.

(21) Appl. No.: 15/425,347

(22) Filed: Feb. 6, 2017

(65) Prior Publication Data

US 2017/0255121 A1 Sep. 7, 2017

(30) Foreign Application Priority Data

Mar. 1, 2016 (JP) ..... 2016-038812

(51) Int. Cl.
*G03G 15/02* (2006.01)
*G03G 21/18* (2006.01)

(52) U.S. Cl.
CPC ..... *G03G 15/0216* (2013.01); *G03G 21/1821* (2013.01)

(58) Field of Classification Search
CPC ..... G03G 21/1889; G03G 15/553
See application file for complete search history.

(56) References Cited

U.S. PATENT DOCUMENTS 5,652,647 A * 7/1997 Yashiro ..... G03G 15/0283 399/111
5,867,751 A * 2/1999 Nomura ..... G03G 15/0216 399/111

(Continued)

FOREIGN PATENT DOCUMENTS

JP 8-62935 A 3/1996
JP 09043939 A * 2/1997

(Continued)

OTHER PUBLICATIONS

Japanese Office Action dated Jul. 24, 2018, issued by the Japanese Patent Office in corresponding application JP 2016-038812.

*Primary Examiner* — Clayton E. LaBalle
*Assistant Examiner* — Leon W Rhodes, Jr.
(74) *Attorney, Agent, or Firm* — Stein IP, LLC

(57) ABSTRACT

A charging device has a charging member, a pair of bearing members, and a frame. The charging member makes contact with an image carrying member to electrostatically charge the surface of the image carrying member. The bearing members rotatably support both end parts of the rotary shaft of the charging member. The frame supports the bearing members movably in the direction perpendicular to the axial direction. The bearing members are arranged selectively at a first position where they are arranged to keep the charging member in contact with the image carrying member or at a second position where they are arranged to keep the charging member apart from the image carrying member. In the bearing members, a restricting portion is formed which, at the second position, makes contact with the inner face of the frame to restrict the movement of the charging member in the axial direction.

6 Claims, 6 Drawing Sheets

(56) References Cited

U.S. PATENT DOCUMENTS

| | | | | |
|---|---|---|---|---|
| 2012/0070187 | A1* | 3/2012 | Takeuchi | G03G 21/181<br>399/111 |
| 2015/0043940 | A1* | 2/2015 | Tsuji | G03G 21/0058<br>399/100 |

FOREIGN PATENT DOCUMENTS

| | | | |
|---|---|---|---|
| JP | 2005-338578 | A | 12/2005 |
| JP | 2007-193207 | A | 8/2007 |
| JP | 2012-88689 | A | 5/2012 |

* cited by examiner

CHARGING DEVICE, AND IMAGE CARRYING MEMBER UNIT AND IMAGE FORMING APPARATUS THEREWITH

INCORPORATION BY REFERENCE

This application is based upon and claims the benefit of priority from the corresponding Japanese Patent Application No. 2016-38812 filed on Mar. 1, 2016, the entire contents of which are incorporated herein by reference.

BACKGROUND

The present disclosure relates to image forming apparatuses exploiting electrophotography, such as copiers, printers, facsimile machines, and multifunction peripherals having the functions of those. More particularly, the present disclosure relates to charging devices provided with a charging member for electrostatically charging an image carrying member, image carrying member units having an image carrying member and a charging device integrated into a unit, and image forming apparatuses provided with them.

Conventionally, in an image forming apparatus, a charging device is used to electrostatically charge the surface of a photosensitive drum as an image carrying member. A charging device can be one adopting a corona charging method, according to which a photosensitive drum and a corona wire are arranged with no contact with each other and the surface of the photosensitive drum is electrostatically charged by corona discharge, or one adopting a contact charging method, according to which a charging member such as a charging roller is brought into contact with the surface of a photosensitive drum to electrostatically charge it. In recent years, however, with a view to reducing the emission of ozone, which is hazardous to the human body, the contact charging method, which emits less ozone, is increasingly preferred to be adopted.

Such a charging device is often integrated, along with a photosensitive drum, into a unit called an image carrying member unit, and to allow maintenance, replacement, and the like of the charging device, the charging device is removably attached to the unit main body.

On the other hand, in recent years, such structures have been proposed as permit a photosensitive drum and a charging roller to be taken apart from each other; for example, an electrophotography process unit is known that is provided with retracting operation means whereby, when a charging unit is taken out of the electrophotography process unit, a charging roller is taken apart from a photosensitive member to be retracted by being moved in the axial direction of the charging roller from the position for charging the photosensitive member unit and a rotating mechanism for rotating about the axis of the charging roller in the process of retraction operation by the retraction operation means.

SUMMARY

According to one aspect of the present disclosure, a charging device includes a charging member, a pair of bearing members, and a frame. The charging member makes contact with an image carrying member to electrostatically charge the surface of the image carrying member. The pair of bearing members rotatably supports both end parts of the rotary shaft of the charging member. The frame supports the bearing members movably in the direction perpendicular to the axial direction. The bearing members are arranged selectively at a first position where they are arranged to keep the charging member in contact with the image carrying member or at a second position where they are arranged to keep the charging member apart from the image carrying member. In the bearing members, a restricting portion is formed which makes contact with the inner face of the frame when the bearing members are arranged at the second position so as to restrict the movement of the charging member in the axial direction.

Further features and advantages of the present disclosure will become apparent from the description of embodiments given below.

DETAILED DESCRIPTION

Figure 1:
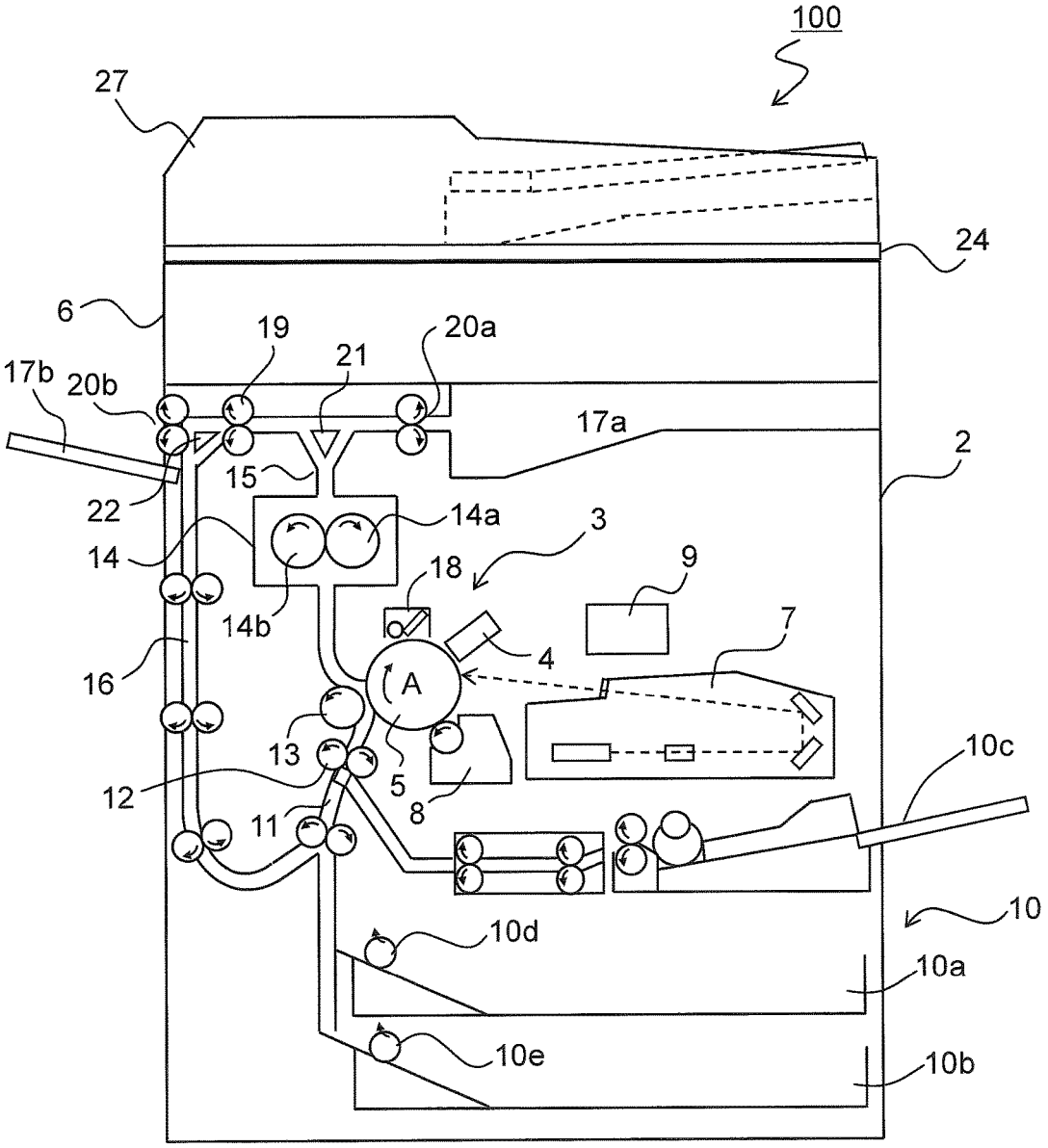
FIG. 1 is a diagram showing an overall structure of an image forming apparatus.

An embodiment of the present disclosure will be described below with reference to the accompanying drawings. FIG. 1 is a diagram showing an overall configuration of an image forming apparatus 100 provided with a drum unit 30 according to the present disclosure. In a lower part of the image forming apparatus 100 (here, a digital multifunction peripheral is taken as an example), a cassette-type sheet feed section 10 is arranged. The sheet feed section 10 has sheet feed cassettes 10*a* and 10*b* in two, upper and lower, tiers, and in the sheet feed cassettes 10*a* and 10*b*, unprinted sheets are stored in the form of stacks. The sheets stored in the sheet feed cassettes 10*a* and 10*b* are fed out, one sheet after another, from the selected sheet feed cassette 10*a* (10*b*) by a sheet pickup roller 10*d* (10*e*), and the sheets fed out are fed into a sheet conveying passage 11.

On the right side face of the image forming apparatus 100, a manual feed tray 10*c* is arranged. On the manual feed tray 10*c*, sheets of a different size from those in the sheet feed cassettes 10*a* and 10*b* can be placed. The sheets placed on the manual feed tray 10*c* are fed out into the sheet conveying passage 11.

The sheet conveying passage 11 is arranged to the left of the sheet feed section 10. A sheet fed out of the sheet feed section 10 is conveyed to a pair of registration rollers over the sheet conveying passage 11. The pair of registration rollers 12 feeds out the sheet toward an image forming section 3 with timing coordinated with the transfer of a toner image to the sheet.

In an upper part of the image forming apparatus 100, a document reading device 6 is arranged; on the top face of the document reading device 6, a platen (document presser) 24 is provided so as to be openable and closable; further on top of the platen 24, a auto document feeder 27 is attached. When a document is copied, out of the document placed on the auto document feeder 27, one sheet after another is separated and fed out to the document reading section so that the image data of the document is read by the document reading device 6.

In a substantially central part of the image forming apparatus 100, the image forming section 3 is arranged. The image forming section 3 includes a photosensitive drum 5 as an image carrying member, and around the photosensitive drum 5, in order along its rotation direction (direction A in the diagram), there are provided a charging device 4, an exposure unit 7, a developing device 8, a transfer roller 13, and a cleaning device 18. The developing device 8 is supplied with toner from a toner container 9. The cleaning device 18 includes a cleaning member such as a blade, a brush, or a polishing roller, and with the cleaning member, scrapes off and collects the toner that remains on the surface of the photosensitive drum 5. The charging device 4, the photosensitive drum 5, and the cleaning device 18 are built into a unit. The unit composed of the charging device 4, the photosensitive drum 5, and the cleaning device 18 will hereinafter be referred to as the drum unit 30.

When the surface of the photosensitive drum 5 is electrostatically charged uniformly with a predetermined polarity and potential by the charging device 4, based on the image data of the document read by the document reading device 6, an electrostatic latent image of the document image is formed on the photosensitive drum 5.

The developing device 8 supplies electrostatically charged toner to the surface of the photosensitive drum 5, and thereby develops the electrostatic latent image on the photosensitive drum 5 to form a toner image. The toner image is transferred to the sheet by the transfer roller 13. The sheet having the toner image transferred to it is conveyed to a fixing device 14. After the toner image has been transferred to the sheet, the toner that remains on the surface of the photosensitive drum 5 is removed and collected by the cleaning device 18, and the residual electric charge on the surface of the photosensitive drum 5 is eliminated by an unillustrated destaticizing device.

The fixing device 14 includes a fixing roller 14*a*, which incorporates a heat source, and a pressing roller 14*b*, and with the fixing roller 14*a* and the pressing roller 14*b*, applies pressure and heat to the sheet having the toner image transferred to it, thereby to fuse and fix the toner image on the sheet. The sheet having the toner image fixed to it is discharged into an in-body sheet discharge portion 17*a* by a pair of discharge rollers 20*a*.

The sheet having the toner image fixed to it is, as necessary, switched between different conveying directions by a path switch guide 21, and is discharged onto a stack tray 17*b* by a pair of discharge rollers 20*b*. In a case where duplex printing is performed, in the middle of discharging into the in-body sheet discharge portion 17*a*, at the timing that the tail end of the sheet has passed the switching guide 21, the pair of discharge rollers 20*a* are rotated reversely, and path switch guides 21 and 22 are switched to lead to a reversal conveying passage 16. Thus, the sheet then, in a state reversed top side down, passes through the reversal conveying passage 16, and is conveyed again from the sheet conveying passage 11 to the pair of registration rollers 12. Subsequently, a toner image is transferred also to the reverse side of the sheet in the image forming section 3, and then the sheet is again subjected to fixing processing by the fixing device 14 and is discharged into the in-body sheet discharge portion 17*a*.

Figure 2:
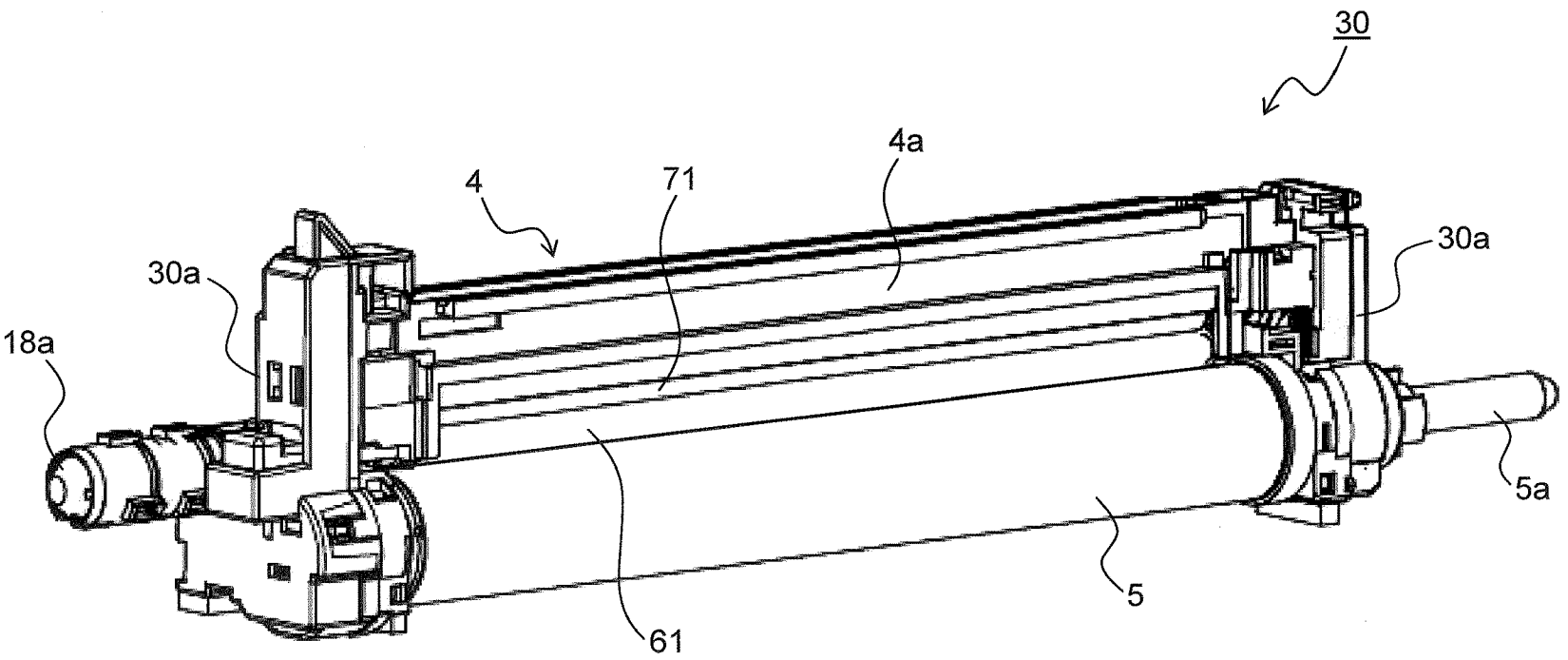
FIG. 2 is an exterior perspective view of a drum unit provided with a charging device according to the present disclosure.

FIG. 2 is an exterior perspective view of the drum unit 30 including the charging device 4 according to the present disclosure. As shown in FIG. 2, the drum unit 30 has a unit housing 30*a* which holds the photosensitive drum 5, the charging device 4, and the cleaning device 18 (see FIG. 1). From one end side (right side in FIG. 2) of the drum unit 30, a drum shaft 5*a* of the photosensitive drum 5 protrudes. The drum shaft 5*a* fits in a bearing hole (not shown) in the main body of the image forming apparatus 100, and thereby the photosensitive drum 5 is positioned in a predetermined position inside the main body of the image forming apparatus 100.

From the other end side (left side in FIG. 2) of the drum unit 30, a toner disposal port 18*a* of the cleaning device 18 protrudes. The waste toner collected by the cleaning device 18 is discharged through the toner disposal port 18*a*, and is conveyed through a waste toner conveying passage to a collection container (neither is illustrated).

The unit housing 30*a*, at both end parts thereof, rotatably supports the drum shaft 5*a* of the photosensitive drum 5. On both end-side inner side faces of the unit housing 30*a*, storage portions (not shown) in which both end parts of the charging device 4 are stored are provided.

Figure 3:
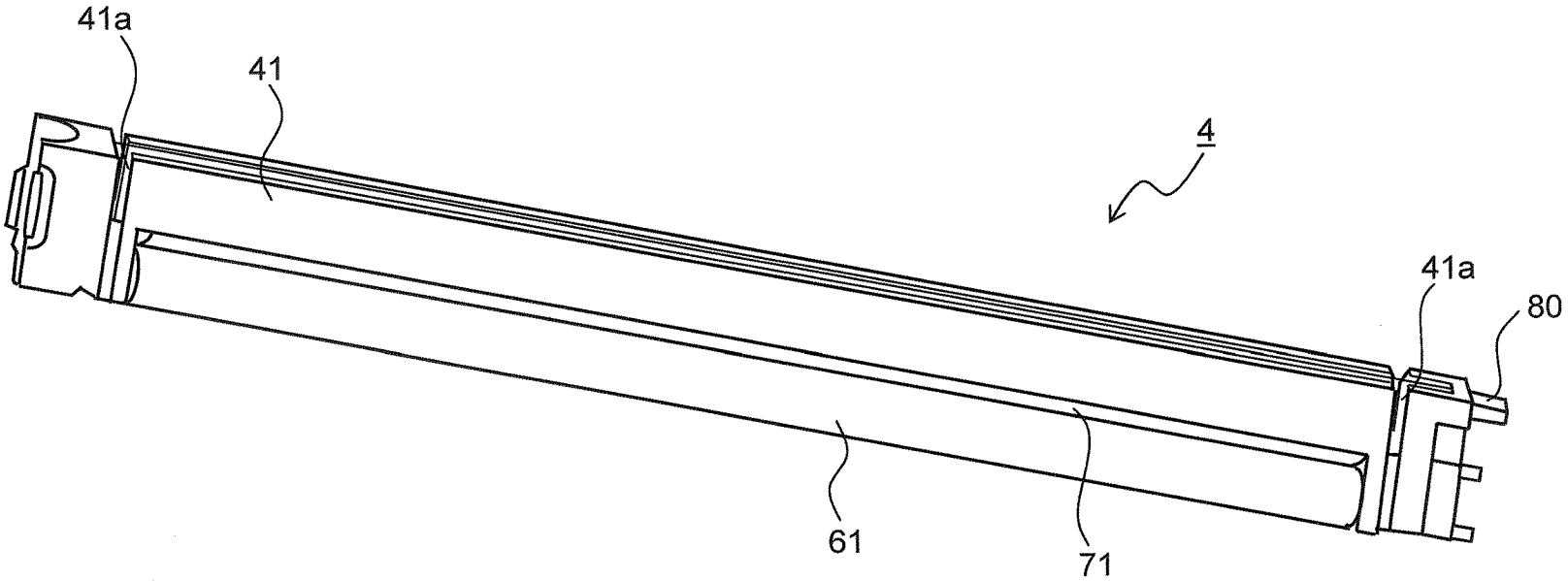
FIG. 3 is an exterior perspective view of the charging device according to an embodiment of the present disclosure.

FIG. 3 is an exterior perspective view of the charging device 4 according to an embodiment of the present disclosure. The charging device 4 includes a frame 41, a charging roller 61 and a cleaning member 71 which are rotatably supported on the frame 41, a pair of bearing members 72 (see FIG. 4) which supports both ends of a rotary shaft 61*a* (see FIG. 6) of the charging roller 61 and a rotary shaft 71*a* (see FIG. 6) of the cleaning member 71, and a contact/non-contact switch lever 80 which permits the bearing members 72 to reciprocate in a direction perpendicular to the axial direction of the charging roller 61.

The charging roller 61 is an electrically conductive rubber roller having an elastic layer of rubber or the like formed on the circumferential face of the rotary shaft 61*a* made of metal. The charging roller 61 is kept in pressed contact with the photosensitive drum 5 with a predetermined nip pressure, and follows the photosensitive drum 5 to rotate. During image formation, the charging roller 61 has a charging bias applied to it via the bearing members 72 and the rotary shaft 61*a*, and electrostatically charges the surface of the photosensitive drum 5.

The cleaning member 71 removes the toner, paper dust from sheets, and the like that are attached to the charging roller 61, and is formed in the form of a brush having fibers of electrically conductive nylon or the like implanted in the surface of the rotary shaft 71*a*. The cleaning member 71 is arranged along the axial direction of, and in parallel with, the charging roller 61, and at the top of the charging roller 61 (on the side opposite from the photosensitive drum 5), lies in contact with the surface of the charging roller 61. The cleaning member 71 may instead be a roller in the form of sponge made of rubber or resin.

Figure 4:
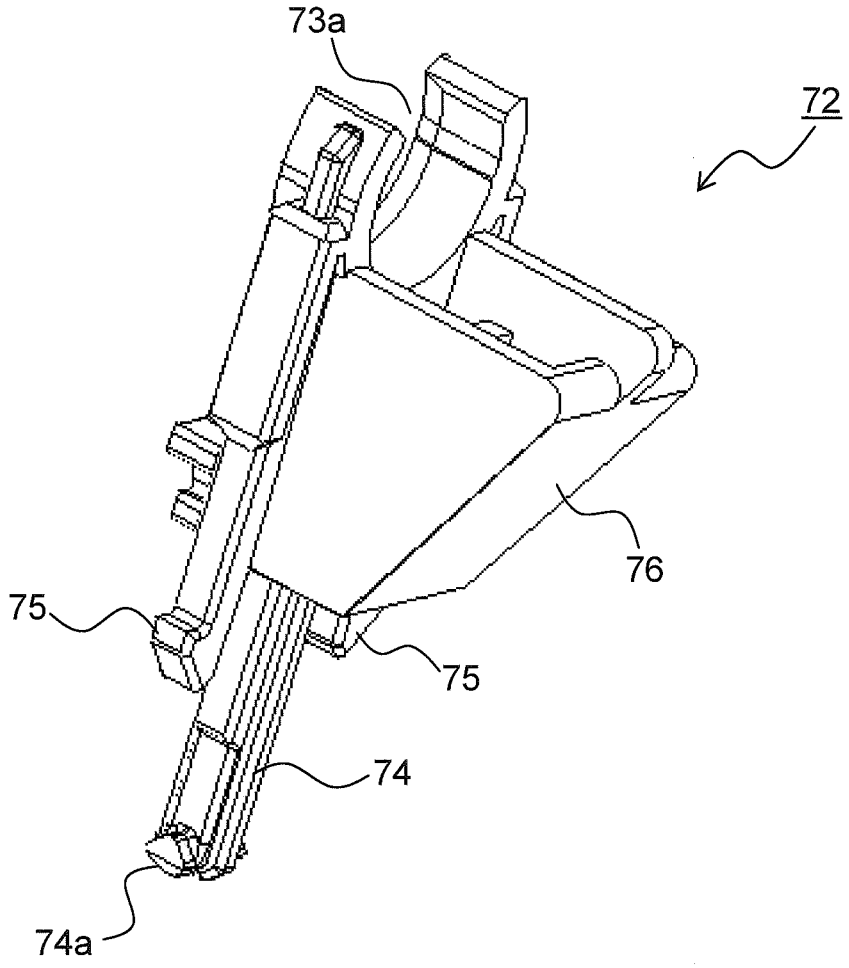
FIG. 4 is a perspective view of a bearing member supporting a rotary shaft of a charging roller.

FIG. 4 is a perspective view of a bearing member 72 which supports the rotary shaft 61*a* of the charging roller 61. The bearing member 72 is formed of electrically conductive resin, and has bearing holes 73*a* and 73*b*, a shaft 74, an engagement claw 75, and a restricting portion 76. Such bearing members 72 are provided in a pair, one at each of both end parts of the charging roller 61.

The bearing hole 73*a* rotatably supports the rotary shaft 61*a* of the charging roller 61. The bearing hole 73*b* (see FIG. 5) rotatably supports the rotary shaft 71*a* of the cleaning member 71. In the pair of bearing members 72, the distance between the two bearing holes 73*a* and 73*b* is the same, and the rotary shaft 61*a* of the charging roller 61 and the rotary shaft 71*a* of the cleaning member 71 are supported at a predetermined interval from each other so that the bearing members 72 keep the cleaning member 71 in uniform contact with the surface of the charging roller 61.

The shaft 74 slidably engages with an engagement groove 81 (see FIG. 5) in a contact/non-contact switch lever 80, which will be described later. At the tip end of the shaft 74, an engagement portion 74*a* which engages with a protruding portion 83 (see FIG. 5) of the contact/non-contact switch lever 80 is formed. The engagement claw 75 slidably engages with a slit 41*a* (see FIG. 3) formed in a side face of the frame 41, and thereby functions as a retainer for a bearing member 72 which moves in a direction perpendicular to the longitudinal direction of the frame 41. The restricting portion 76 makes contact with the frame 41 when the charging roller 61 is apart from the photosensitive drum 5, and thereby restricts the movement of the charging roller 61 in the axial direction.

Figure 5:
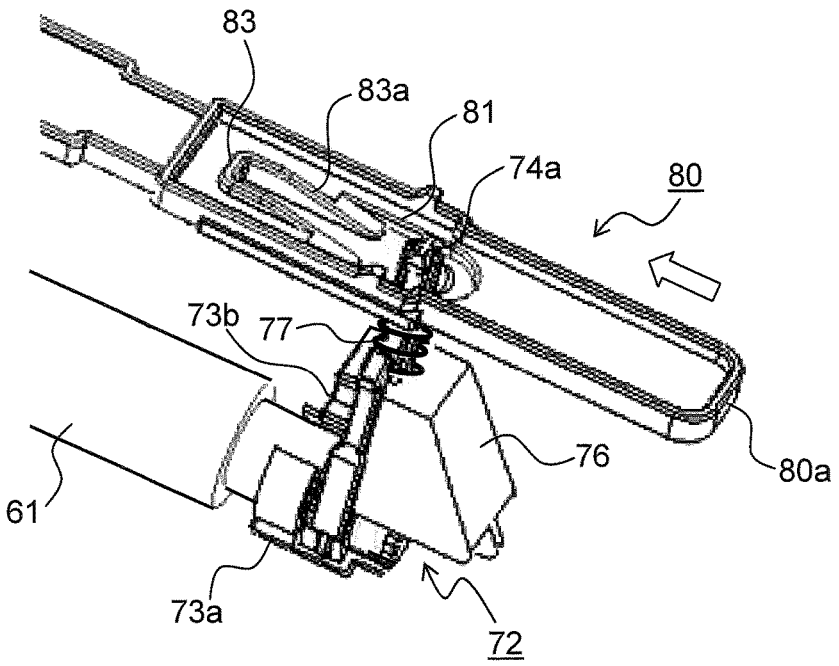
FIG. 5 is a partial perspective view around the bearing member of the charging roller in a state where the charging roller is in contact with the photosensitive drum.
Figure 6:
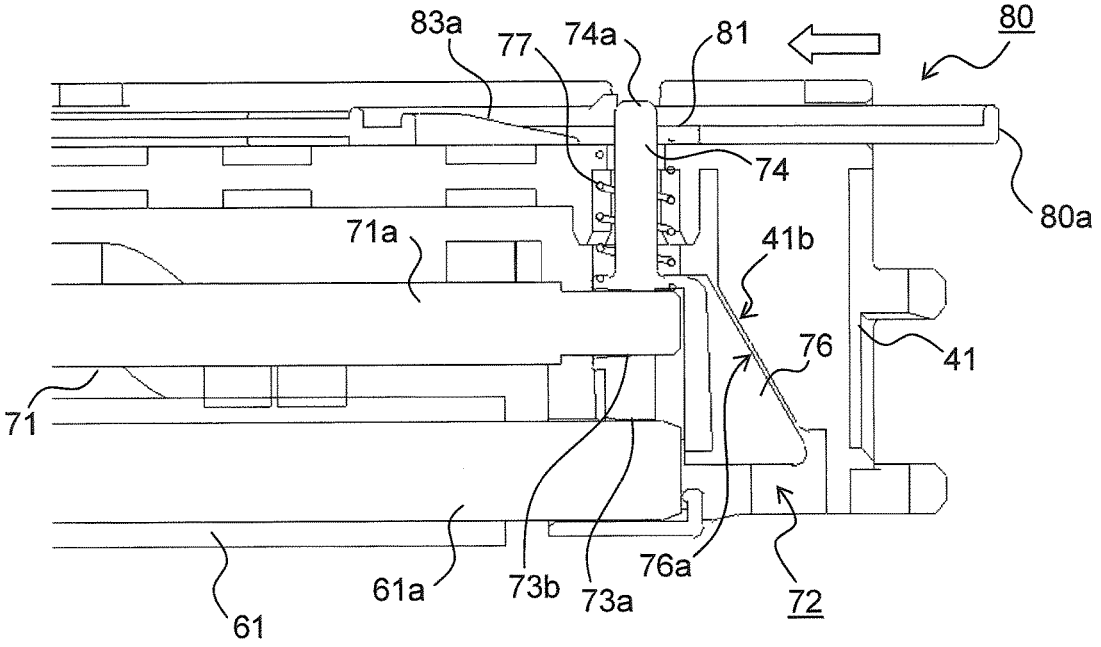
FIG. 6 is a side sectional view around the bearing member of the charging roller in a state where the charging roller is in contact with the photosensitive drum.
Figure 7:
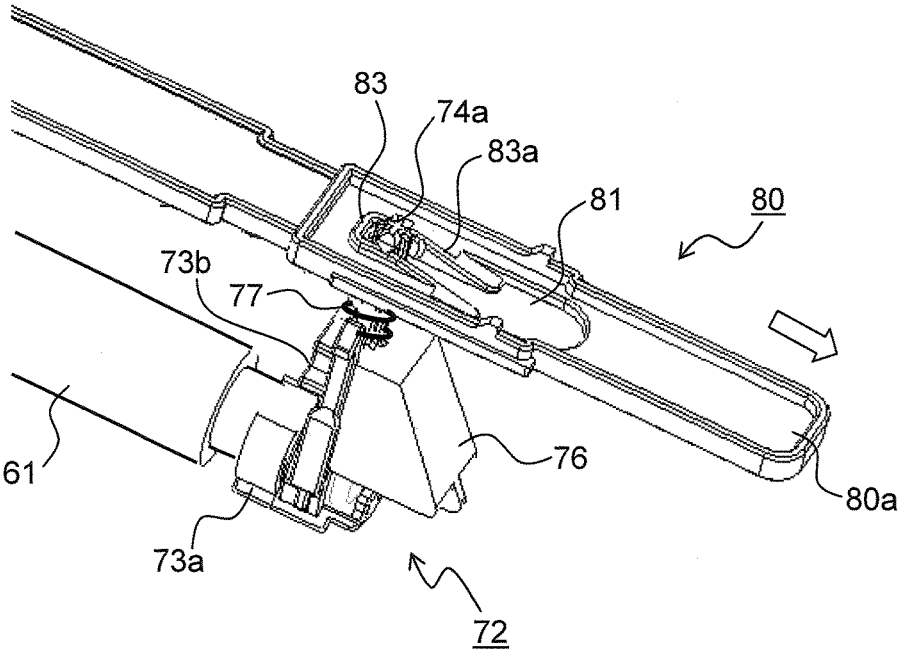
FIG. 7 is a partial perspective view around the bearing member of the charging roller in a state where the charging roller is apart from the photosensitive drum.
Figure 8:
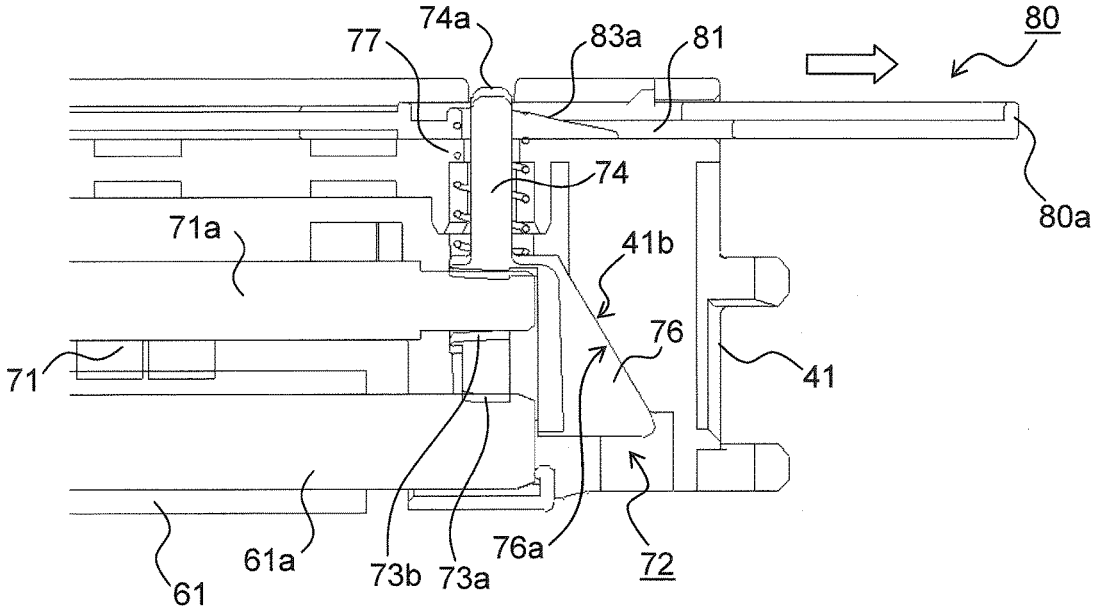
FIG. 8 is a side sectional view around the bearing member of the charging roller in a state where the charging roller is apart from the photosensitive drum.

FIGS. 5 and 6 are a partial perspective view and a side sectional view, respectively, around the bearing member 72 of the charging roller 61 in a state where the charging roller 61 is in contact with the photosensitive drum 5, and FIGS. 7 and 8 are a partial perspective view and a side sectional view, respectively, around the bearing member 72 of the charging roller 61 in a state where the charging roller 61 is apart from the photosensitive drum 5. With reference to FIGS. 5 to 8, a contact/non-contact mechanism for the charging roller 61 relative to the photosensitive drum 5 will be described. For convenience' sake, in FIGS. 5 and 7, only the charging roller 61, the bearing member 72, and the contact/non-contact switch lever 80 are shown, and in FIGS. 5 to 8, the photosensitive drum 5, which is located under the charging roller 61, is omitted from illustration. While FIGS. 5 to 8 show the structure on one end side (right end side in FIG. 3) of the charging device 4, the structure on the other end side (left end side in FIG. 3) of the charging device 4 is basically similar.

The bearing member 72 is supported such that it is positioned in the axial direction (left/right direction in FIGS. 6 and 8) of the charging roller 61 and in the width direction (direction perpendicular to the plane of FIGS. 6 and 8) of the frame 41. On the other hand, the bearing member 72 is supported such that it is movable in the direction (up/down direction in FIGS. 6 and 8) in which it moves toward and away from the photosensitive drum 5 (see FIG. 2).

A pressing spring 77 lies in contact with a top part of the bearing member 72 and in contact with the inner side of the top face of the frame 41 to bias the bearing member 72 to the photosensitive drum 5 side (downward in FIG. 5). The pressing spring 77 is formed of metal wire in a coil form, and is connected to a high voltage source (not shown) in the main body of the image forming apparatus 100 so as to be capable of applying a predetermined voltage to the charging roller 61 via the bearing member 72 and the rotary shaft 61*a*.

The contact/non-contact switch lever 80 is a member in the form of a flat plate with an end portion 80*a* protruding from it, and is supported so as to be slidable in the longitudinal direction of the frame 41. In the contact/non-contact switch lever 80, an engagement groove 81 in the form of an elongate hole with which the shaft 74 (see FIG. 3) of the bearing member 72 engages is formed. On the obverse face side (side opposite from the bearing member 72) of the contact/non-contact switch lever 80, a protruding portion 83 which protrudes in the form of a rib is formed. The engagement groove 81 is narrower at the side (left side in FIGS. 5 and 7) far from the end portion 80*a*, and the protruding portion 83 is formed substantially in a U shape so as to overlap a circumferential edge part of the engagement groove 81 at the side far from the end portion 80*a*. The protruding portion 83 has an inclined portion 83*a* which has an upward gradient as seen from the end portion 80*a* side.

When the drum unit 30 is attached to the main body of the image forming apparatus 100, as shown in FIGS. 5 and 6, the contact/non-contact switch lever 80 is slid in a direction (first direction) in which it is pushed into the frame 41. Thus, the engagement portion 74*a* moves to the end portion 80*a* side along the inclined portion 83*a*, and the engagement portion 74*a* and the protruding portion 83 are disengaged from each other.

As a result, under the biasing force of the pressing spring 77, the bearing member 72 moves downward in the FIGS. 5 and 6 so that, as shown in FIGS. 5 and 6, the charging roller 61 is arranged at a position (hereinafter referred to as the first position) in contact with the photosensitive drum 5. Under the biasing force of the pressing spring 77, the charging roller 61 is kept in pressed contact with the surface of the photosensitive drum 5 via the bearing member 72 with a predetermined nip pressure. At this time, as shown in FIG. 6, a restricting face 76*a* of the restricting portion 76 is apart from the inner face 41*b* of the frame 41.

When the drum unit 30 is transported (packed), the contact/non-contact switch lever 80 is slid from the state in FIGS. 5 and 6 in such a direction (second direction) as to move away from the frame 41. Thus, as shown in FIG. 7, the engagement position between the engagement groove 81 and the shaft 74 moves to the side far from the end portion 80*a*, and the engagement portion 74*a* formed at the tip end of the shaft 74 runs on the protruding portion 83 along the inclined portion 83*a*.

As a result, against the biasing force of the pressing spring 77, the bearing member 72 moves upward in FIGS. 7 and 8 so that the charging roller 61 is arranged at a position (hereinafter referred to as the second position) apart from the photosensitive drum 5. At this time, as shown in FIG. 8, the restricting face 76*a* of the restricting portion 76 makes contact with the inner face 41*b* of the frame 41, and thus the movement of the charging roller 61 in the axial direction is restricted.

According to the embodiment, during the transportation of the drum unit 30, when the bearing member 72 is arranged at the second position and the charging roller 61 is apart from the photosensitive drum 5, the restricting portion 76 of the bearing member 72 is in contact with the inner face of the frame 41. Thus, the load of the charging roller 61 as when an impact is applied to the drum unit 30 can be borne by the frame 41 via the bearing member 72. It is thus possible to prevent the load of the charging roller 61 from concentrating on the bearing member 72, and to effectively suppress breakage of the bearing member 72.

Moreover, with the shape of the bearing member 72 alone, the load acting on the bearing member 72 can be buffered; it is thus possible, without the need to add a member for buffering the load acting on the bearing member 72, to contribute to component number reduction and cost reduction. In addition, since no increase in the packed exterior dimensions is involved, it is also possible to suppress an increase in packing and transport costs.

Furthermore, even in a case where the charging device 4 removed from the drum unit 30 is transported alone, by arranging the bearing member 72 at the second position where the restricting portion 76 makes contact with the inner face of the frame 41, it is possible to bear the load of the charging roller 61 as when an impact is applied to the charging device 4 with the frame 41 via the bearing member 72.

Incidentally, when the photosensitive drum 5 is electrostatically charged by the charging roller 61, it is important to keep the charging roller 61 in contact with the photosensitive drum 5 with a previously set pressing force by the biasing force of the pressing spring 77. To achieve that, while in a state where the charging roller 61 is apart from the photosensitive drum 5, the inner face 41*b* of the frame 41 and the restricting face 76*a* are kept in contact with each other to bear the load of the charging roller 61, in a state where the charging roller 61 is in contact with the photosensitive drum 5, the inner face 41*b* of the frame 41 and the restricting face 76*a* need to be kept apart from each other.

At this time, if the restricting face 76*a* is perpendicular to the axial direction of the charging roller 61, taking the inner face 41*b* of the frame 41 and the restricting face 76*a* apart from each other requires the restricting face 76*a* of the restricting portion 76 to be moved up to a position where the inner face 41*b* of the frame 41 is interrupted. For example, in a case where the inner face 41*b* of the frame 41 reaches the same height as the outer circumferential face of the charging roller 61, the bearing member 72 needs to be moved at least over a distance corresponding to the diameter of the charging roller 61. As a result, the bearing member 72, when moved between the first and second positions, needs to be moved over a longer movement distance (stroke).

In this embodiment, the restricting face 76*a* of the restricting portion 76 which makes contact with the inner face 41*b* of the frame 41 is a face inclined relative to the axial direction of the charging roller 61. Thus, even with a shorter distance over which the bearing member 72 is moved between the first and second positions, it is possible to reliably bring the restricting face 76*a* and the inner face of the frame 41 into contact with and apart from each other. It is thus possible to reduce the dimension of the charging device 4 in the direction perpendicular to the axial direction of the charging roller 61, and to make the drum unit 30 compact.

The present disclosure is not limited to the embodiment described above and encompasses various modifications within the spirit of the present disclosure. For example, although the above embodiment deals with a structure where, when the contact/non-contact switch lever 80 is pulled out of the frame 41, the charging roller 61 is arranged in the apart position and, when the contact/non-contact switch lever 80 is pushed into the frame 41, the charging roller 61 is arranged in the contact position, instead the protruding portion 83 of the contact/non-contact switch lever 80 may be formed at the end portion 80*a* side. In that case, when the contact/non-contact switch lever 80 is pulled out, the charging roller 61 is arranged in the contact position, and when the contact/non-contact switch lever 80 is pushed in, the charging roller 61 is arranged in the apart position.

The present disclosure is applicable not only to digital multifunction peripherals (having the functions of a copier, a facsimile machine, a scanner, and the like integrated together, and called MFPs) like the one shown in FIG. 1, but also quite equally to any other types of image forming apparatuses, such as monochrome printers, color printers, and monochrome and color copiers, provided with a drum unit 30 to which a charging device 4 is removably attached.

The present disclosure is applicable to charging devices provided with a charging member for electrostatically charging an image carrying member and a bearing member for supporting the rotary shaft of the charging device. Based on the present disclosure, it is possible to provide a charging device that can suppress breakage of a bearing member with a simple structure, and an image carrying member unit and an image forming apparatus incorporating such a charging device.

What is claimed is:

1. A charging device comprising:

a charging member in contact with an image carrying member, the charging member electrostatically charging a surface of the image carrying member;

a pair of bearing members having bearing holes rotatably supporting both end parts of a rotary shaft of the charging member, and a pair of engagement claws protruding in a direction perpendicular to an axial direction of the rotary shaft; and a frame having slits with which the pair of engagement claws slidably engage, the frame supporting the pair of bearing members movably in a direction perpendicular to the axial direction, wherein the bearing members are arranged selectively at a first position where the bearing members are arranged to keep the charging member in contact with the image carrying member or at a second position where the bearing members are arranged to keep the charging member apart from the image carrying member, and in the bearing members, a restricting portion is formed so as to protrude in the axial direction, the restricting portion being apart from an inner face of the frame when the bearing members are arranged at the first position, the restricting portion making contact with the inner face of the frame when the bearing members are arranged at the second position.

2. The charging device of claim 1, wherein the restricting portion has a restricting face that makes contact with the inner face of the frame and that is inclined relative to an axial direction of the charging member.

3. The charging device of claim 1, further comprising:

a contact/non-contact switch lever having an elongate hole-form engagement groove with which an engagement portion of the bearing members slidably engages, the contact/non-contact switch lever being slidable in a longitudinal direction of the charging member; and a biasing member biasing the bearing members in a direction in which the bearing members move away from the contact/non-contact switch lever, wherein in the contact/non-contact switch lever, there is formed a protruding portion along a circumferential edge part of the engagement groove, and as the contact/non-contact switch lever slides in a first direction, the engagement portion runs off the protruding portion under a biasing force of the biasing member so that the bearing members are arranged at the first position and, as the contact/non-contact switch lever slides in a second direction opposite to the first direction, the protruding portion runs on the protruding portion against the biasing force of the biasing member so that the bearing members are arranged at the second position.

4. The charging device of claim 3, wherein the bearing members and the biasing member are formed of an electrically conductive material so that a voltage is applicable to the charging member via the bearing members and the biasing member.

5. An image carrying member unit comprising:

the charging device of claim 1; and the image carrying member having a surface thereof electrostatically charged by the charging member so that an electrostatic latent image is formed on the surface.

6. An image forming apparatus comprising the image carrying member unit of claim 5.

* * * * *